US007568921B2

(12) United States Patent
Pavlovic et al.

(10) Patent No.: US 7,568,921 B2
(45) Date of Patent: Aug. 4, 2009

(54) FUSE CASSETTE

(75) Inventors: Slobadan Pavlovic, Canton, MI (US); Mohamad Zeidan, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/750,659

(22) Filed: May 18, 2007

(65) Prior Publication Data

US 2008/0050981 A1 Feb. 28, 2008

Related U.S. Application Data

(60) Provisional application No. 60/839,214, filed on Aug. 22, 2006.

(51) Int. Cl.
*H01R 12/00* (2006.01)

(52) U.S. Cl. ..... 439/76.2; 439/620.26; 439/620.27

(58) Field of Classification Search ..... 439/76.2, 439/620.26, 620.27
See application file for complete search history.

(56) References Cited

U.S. PATENT DOCUMENTS

| | | | | |
|---|---|---|---|---|
| 4,012,707 | A * | 3/1977 | Marek et al. | 337/27 |
| 4,992,062 | A * | 2/1991 | Nakayama et al. | 439/620.26 |
| 5,906,514 | A | 5/1999 | Nelson, Jr. | |
| 5,977,859 | A * | 11/1999 | Kawamura et al. | 337/295 |
| 6,257,938 | B1 * | 7/2001 | Day et al. | 439/723 |
| 6,759,938 | B2 * | 7/2004 | Matsumura et al. | 337/161 |
| 7,071,808 | B2 * | 7/2006 | Nakamura | 337/256 |
| 7,121,847 | B1 * | 10/2006 | Jetton et al. | 439/76.2 |
| 2005/0285709 | A1 | 12/2005 | Matsumura et al. | |

FOREIGN PATENT DOCUMENTS

| | | | |
|---|---|---|---|
| DE | 102004052476 | A1 | 6/2005 |
| EP | 0966015 | A1 | 12/1999 |
| EP | 1211709 | A2 | 6/2002 |
| GB | 2326287 | A | 12/1998 |
| JP | 4131845 | U | 12/1992 |
| JP | 200030600 | A | 1/2000 |
| JP | 2000133114 | A | 5/2000 |

OTHER PUBLICATIONS

Great Britain Search and Examination Report for Application No. GB0715858.7, mailed Oct. 31, 2007, 6 pages.
German Office Action for corresponding Application No. 10 2007 039 437.5, mailed Nov. 18, 2008, 5 pages.

* cited by examiner

*Primary Examiner*—Tho D Ta
*Assistant Examiner*—Travis Chambers
(74) *Attorney, Agent, or Firm*—Brooks Kushman P.C.

(57) ABSTRACT

A fuse cassette for use with Power Distribution Boxes (PDBs) and other electrical devices. The fuse cassette may include a fuse circuit having a power distribution bar for distributing power between a number of terminals. The terminals may include electrical traces having fuse-like characteristics. The traces may open during over current conditions to protect the PDB and devices connected thereto from over current conditions.

11 Claims, 4 Drawing Sheets

FUSE CASSETTE

CROSS-REFERENCE TO RELATED APPLICATIONS

This application claims the benefit of U.S. provisional application Ser. No. 60/839,214 filed Aug. 22, 2006.

BACKGROUND OF THE INVENTION

1. Field of the Invention

The present invention relates to a fuse cassette suitable for use with power distribution boxes (PDBs), such as but not limited to those commonly found in automobiles.

2. Background Art

Power distribution boxes (PDBs) are commonly employed in automobiles and other environments to support electrical power distribution between a power source and a number of loads. The PDBs typically include a busbar or other feature to relay the power to the electrical loads. In some case, it can helpful to include fuses within the PDB to protect against over current conditions. When a fuse blows, the current supplied to the load is prevented until the blown fuse is discarded and replaced. Accordingly, a need exits to facilitate discarding and replacing the blown fuses.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
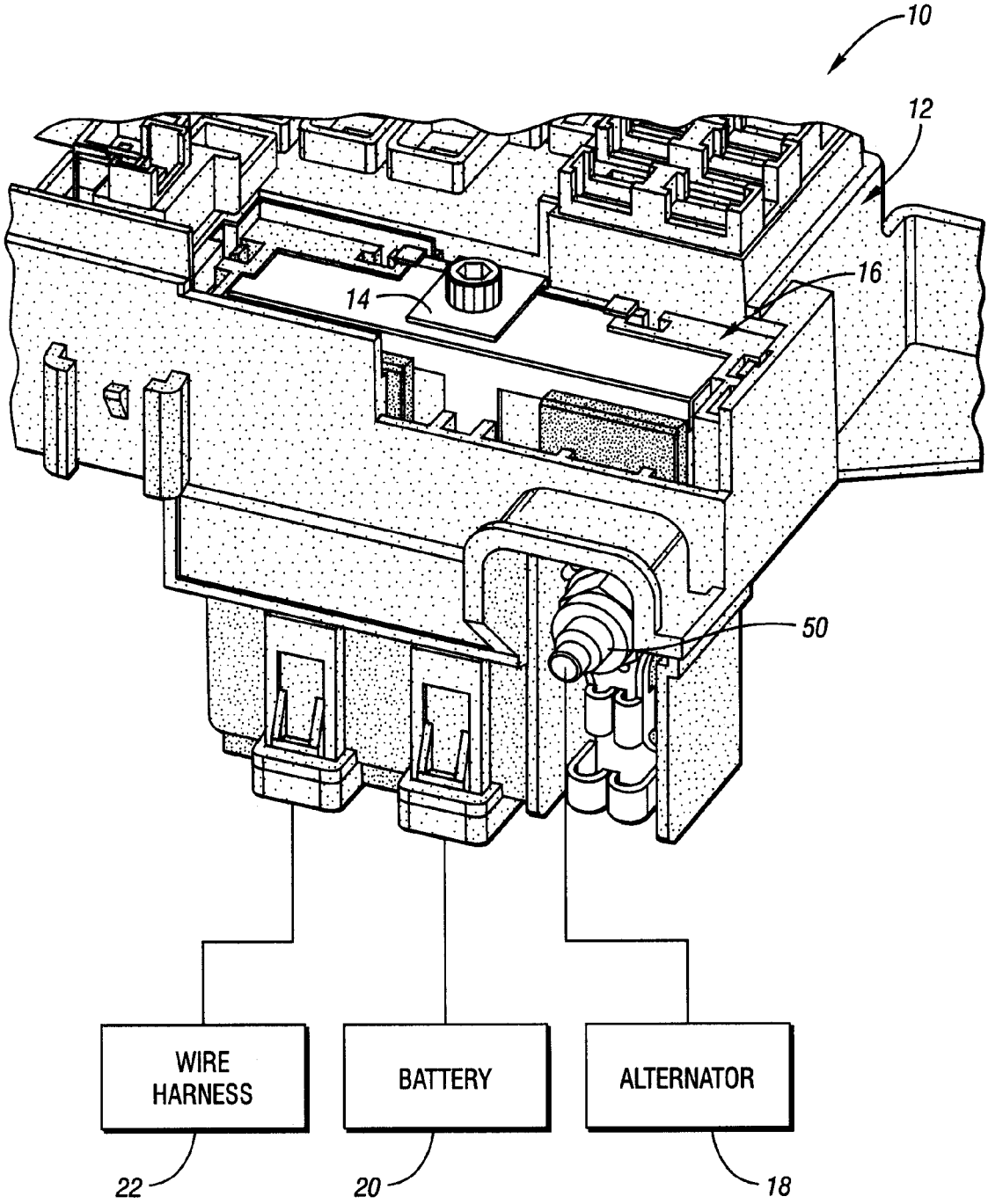
FIG. 1 illustrates a power distribution box (PDB) system in accordance with one non-limiting aspect of the present invention.

FIG. 1 illustrates a power distribution box (PDB) system 10 in accordance with one non-limiting aspect of the present invention. The system 10 includes a PDB 12 having a busbar 14 for distributing electrical power to a number of loads (not shown). A fuse cassette 16 facilitates connecting the PDB 12 to a vehicle alternator 18, a vehicle battery 20, and a vehicle wire harness 22. In operation, power may be provided to the fuse cassette 16 by way of the alternator (generator) 18 for distribution to the battery 20, wire harness 22, and PDB loads. The system 10 is described with respect to a vehicle and its attendant features for exemplary purposes only. The present fully contemplates its use and application in any number of environments.

Figure 2:
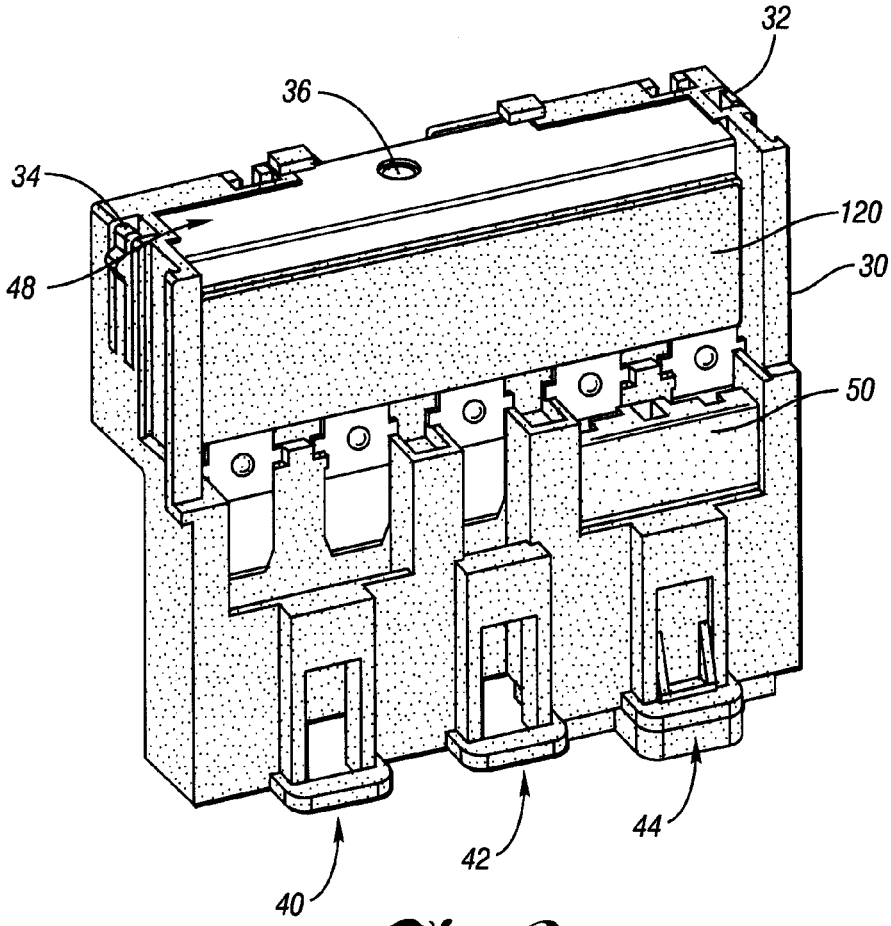
FIG. 2 illustrates a fuse cassette in accordance with one non-limiting aspect of the present invention.

FIG. 2 illustrates the fuse cassette 16 in accordance with one non-limiting aspect of the present invention. The cassette 16 may include a housing 30 composed of plastic or other suitable feature. The housing 30 may be configured for receipt within a correspondingly configured receptacle of the PDB 12. The cassette 16 and PDB 12 may include clips, fasteners, and other elements suitable to facilitate securing the cassette within the PDB 12, such as laterally compressible tabs 32-34 having an uncompressed state for retaining the housing 30 within the PDB 12 and a compressed state for releasing the housing 30 from the PDB 12. Optionally, the securing features may be of the type suitable for use in a plug-in-play and/or drop-in assembly processes that requires minimal in any manual operation for assembly. The cassette 16 ay include a nut 36 connection for additionally securing the cassette to the busbar.

The cassette 16 may include any number of slots 40-44 to facilitate making electrical connections between a fuse circuit 48 and one or more connectors 50-54. The connectors 50-54 may be connected to cables, wires, and other elements within the vehicle, which for exemplary purposes are shown to be connected to the alternator 18, battery 20, and wire harness 22. The cassette 16 and connectors 50-54 may include corresponding features to facilitate plug-in-play and/or drop-in attachment to the slots 40-44. Contrary to FIG. 1, the fuse cassette shown in FIG. 2 includes a plug-in connector 50 instead of the threaded connector 50 shown in FIG. 1. The plug-in connector 50 may be easily inserted and removed by compressing the sides of the connector 50 versus the unthreading required to remove the thread connector 50.

Figure 3:
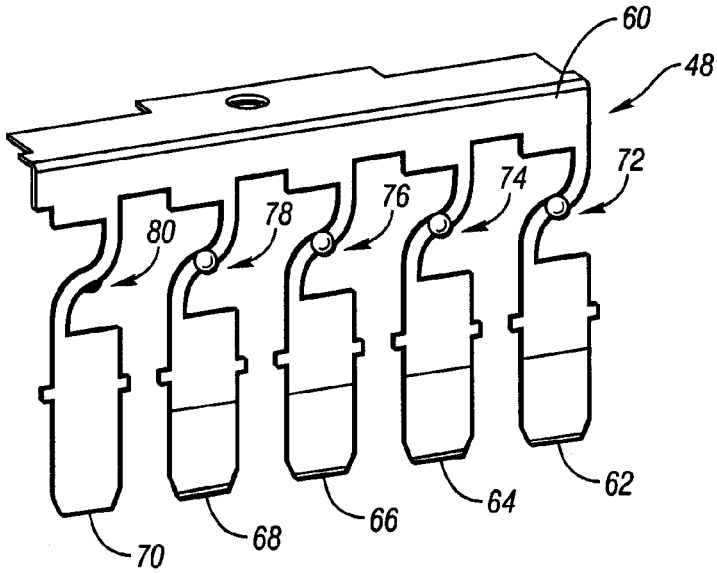
FIGS. 3-4 illustrate a fuse circuit in accordance with one non-limiting aspect of the present invention.
Figure 4:
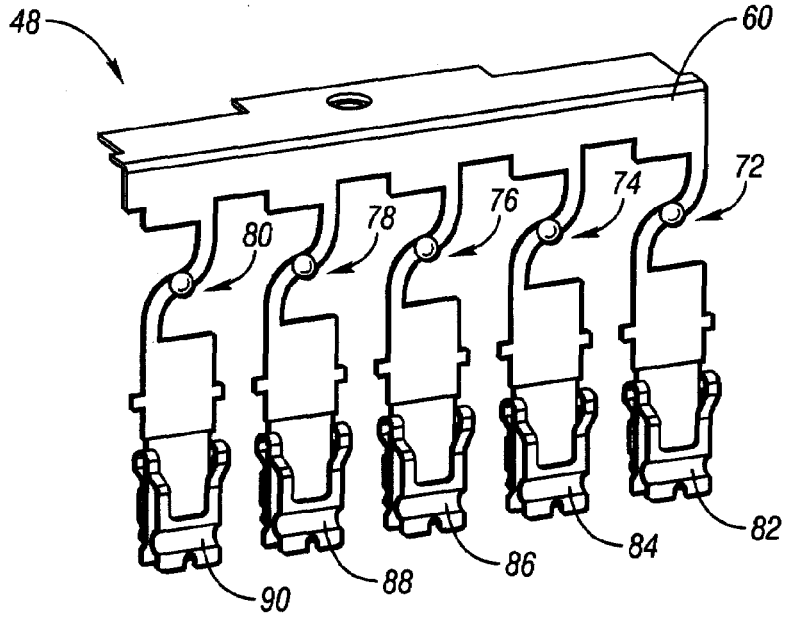

FIGS. 3-4 illustrate the fuse circuit 48 in accordance with one non-limiting aspect of the present invention. The fuse circuit 48 may include a power distribution bar 60 to distribute electrical power between a number of terminals 62-70. Each of the terminals 62-70 may include an electrical trace 72-80 having characteristics that cause the trace 72-80 to open during over current conditions, such as but not limited to having a smaller dimension than the rest of the terminal 62-70 and/or or portion having a material (tin) that melts before the rest of the terminal 62-70. As one skilled in the art will appreciate, the characteristics of the traces 72-80 may be selected to correspond with desired over current operating conditions.

In this manner, one or more of the fuses 72-80 may open during over current or other operating conditions. This may cause rather high temperatures within cassette 16, as opposed to configurations that include an heat sink or more robust configuration between the terminals and the cables, such as but not limited to stud or bolt based connections commonly employed with the alternator connections. The cassette 16 may melt or otherwise experience permanent deformation in response to such heating such that the entire cassette 16 must be discarded and replace if one of the fuses blow.

FIG. 3 illustrates a male version of the fuse circuit 48 having male terminals shaped as blades. FIG. 4 illustrate a female version of the fuse circuit 48 having spring clips 82-90 connected to the blades in order to provide female terminals. While each terminal 62-70 is shown to include the female terminals, the present invention fully contemplates the circuit 48 including one or more female features so as to provide both male and female terminals. The female terminals may be advantageous for use in higher current or generally more robust operations where the springs may be damaged during shorts or other high current conditions associated with replacing the cassette 16 such that only the cassette needs to be replaced to replace the female spring clips instead of replacing the cable connectors should the connectors include the female spring clips.

The fuse circuit 48 illustrated in FIGS. 3-4 may be stamped circuit stamped form a single piece of material, which may portions having different types of material. Optionally, one or more portions of the fuse circuit, such as the power distribution bus, terminals, or traces, may be separately stamped and thereafter electrically adhered to one another, such as through welding, soldering, or some other operation. This may include utilizing the fuse material to attach the upper and lower portions of the terminals, i.e., the portions on either side of the fuse, to each other.

Figure 5:
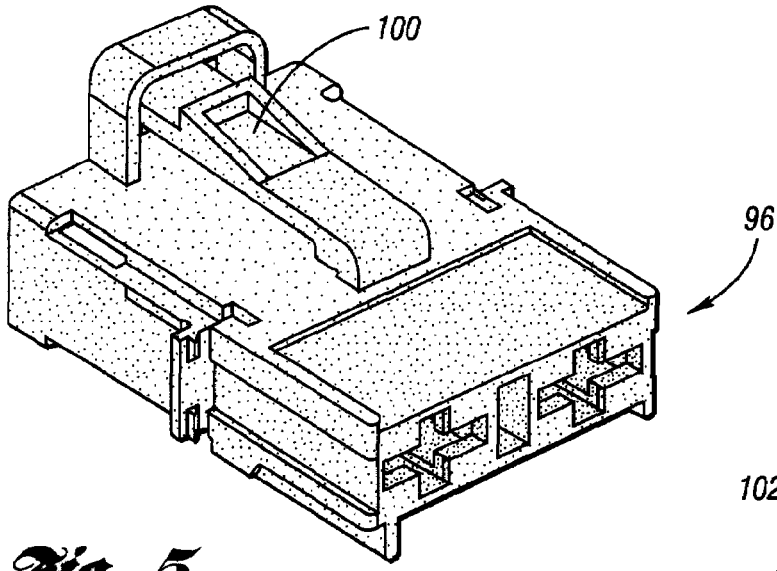
FIGS. 5-6 illustrate connectors in accordance with one non-limiting aspect of the present invention.
Figure 6:
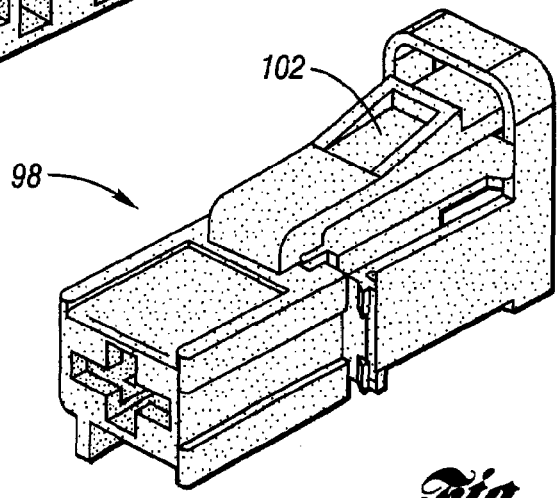

FIGS. 5-6 illustrate connectors 96-98 that may be used to connect to the terminals 62-70 in accordance with one non-limiting aspect of the present invention. The connector 96 shown in FIG. 5 is a dual connector and the connector 98 shown in FIG. 6 is a single connector. The connectors 96-98 may include compressible tabs 100-102 for removable receipt within the slots 40-44. The connectors 96-98 may connect to a single cable (FIG. 6) or multiple cables (FIG. 5) for communicating the electrical power with a device connected thereto. The connectors 96-98 may be connected to the cables prior to insertion and/or after insertion of the cassette 16 within the PDB 12. This allows the present invention to provide a relatively easy assembly process that may be executed with minimal manual operations, aside from simply inserting the element within self-locking receiving apertures.

The dual connector 96 may connect to two of the terminals 62-70 so as to provide parallel fusing, as shown for the alternator 18 and wire harness 22 connections. Optionally, this may include connecting two cables, in place of the commonly used single cable, between the devices and the cassette or splicing a single wire to include an end with two connection points. This allows the present invention to use two smaller gauge cables (optionally six gauge or less) in place of the commonly used single, larger gauge cable (optionally two or four gauge). This also allows the present invention to use smaller fuses, such as but not limited to two 100A fuses in place of the commonly used 200A fuse, with cables that are easier to manipulate and assemble.

Figure 7:
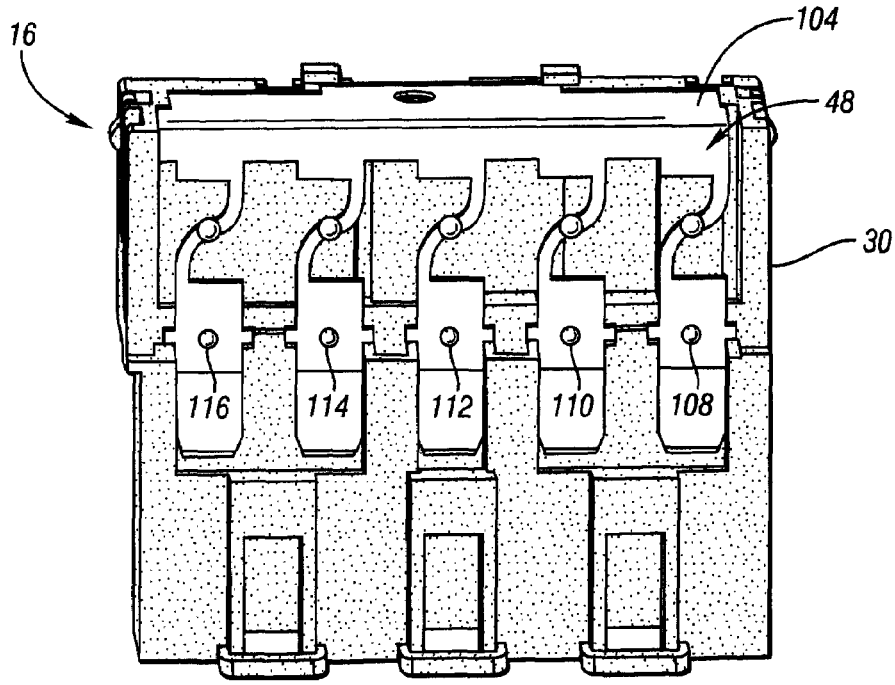
FIG. 7 illustrates a partial assembly view of the cassette in accordance with one non-limiting aspect of the present invention.

FIG. 7 illustrates a partial assembly view of the cassette 16 in accordance with one non-limiting aspect of the present invention. This view illustrates the assembly of the fuse circuit 48 relative to the housing 30 by simply placing the fuse circuit 48 on a shelf within the housing 30 such that a laterally extending portion 104 of the fuse circuit 48 rest on a top side of the housing shelf. Alignment features 108-116 may be configured to facilitate orientating the fuse circuit 48 relative to the housing 30. The alignment features 108-116 may be optionally staked or sonic welded to facilitate permanently adhering the fuse to the shell.

Returning to FIG. 2, an optional cover 120 may be staked or sonic welded to the shell to facilitate permanently adhering the fuse circuit 48 to the housing 30. The cover 120 may be used to cover the fuse circuit 48 and secure it within the cassette 16. The cassette 16 may be rather simply assembled by positioning the fuse circuit 48 within the shell and welding the cover 120 over the same, as opposed to providing a protective cover over both sides of the fuse circuit 48 prior to loading it within the shell.

Figure 8:
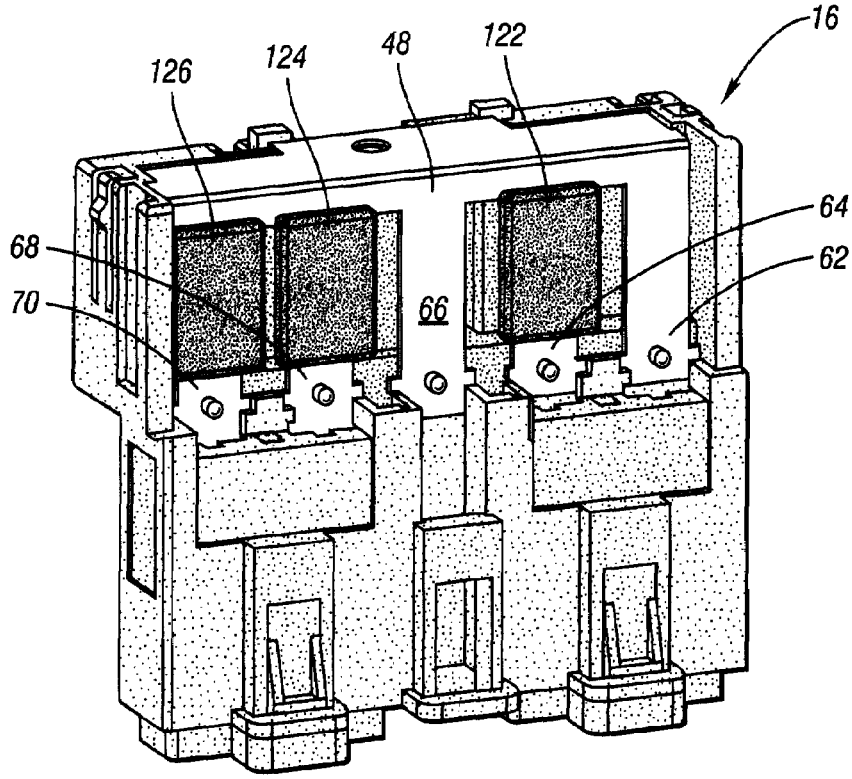
FIG. 8 illustrates another assembled view of the cassette in accordance with one non-limiting aspect of the present invention.

FIG. 8 illustrates another assembled view of the cassette 16 in accordance with one non-limiting aspect of the present invention. This view illustrates discrete coverings 122-126 that may be used to cover one or more of the fuse terminals 62-70 in manner similar to the full covering described above in the coverings associated with FIG. 8. The discrete coverings 122-126 may be sonic welded to the shell for one or more of the active fuses.

As described above, one non-limiting aspect of the present invention relates to a replaceable fuse cassette that may be used with PDBs. The cassette may be constructed such that the fuse circuit is permanently adhered to the housing, requiring the entire cassette to be discarded and replaced each time a fuse blows. This type of disposable, melting cassette can protect the PDB from heat generated during fuse shortings as the temperatures are absorbed by the cassette and melting plastic, rather than being transferred through to the rest of the PDB.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fuse cassette for use with a power distribution box (PDB), the cassette comprising:

a housing having a number of slots configured for removably securing a number of electrical connectors, the housing configured for removable receipt within the PDB;

a fuse circuit permanently adhered within the housing, the fuse circuit having a power distribution bar for distributing power from a power input to a number of terminals, each terminal including an electrical trace configured to act as a fuse by opening at an over current threshold in order to prevent current flow therethrough;

wherein the permanent adherence of the fuse circuit within the housing requires the entire fuse cassette to be discarded and replaced if one of the fuses opens due to current exceeding the over current threshold;

a covering permanently adhered to the housing to cover an exposed portion of the fuse circuit; and wherein the covering extends across the fuse circuit such that the covering covers at least a portion of the power distribution bar and a portion of the terminals extending to an alignment feature included on the housing and protruding through the fuse circuit, the electrical traces being located behind the covering.

2. The cassette of claim 1 wherein the housing includes one or more compressible tabs to removable secure the housing within the PDB, the tabs having an uncompressed state for retaining the housing within the PDB and a compressed state for releasing the housing from the PDB.

3. The cassette of claim 1 wherein the housing includes a number protrusions for receipt within a number of openings within the fuse circuit to facilitate aligning the terminals with the connector slots.

4. The cassette of claim 1 wherein the power distribution bar includes a predominately laterally extending portion that extends across a top of the housing and a predominately vertically extending portion that extends across a side of the housing, the covering covering a portion of the vertically extending portion and not the laterally extending portion.

5. The cassette of claim 1 wherein at least one of the terminals is shaped as a blade to form a male connector.

6. The cassette of claim 1 wherein the fuse circuit is a stamped circuit.

7. The cassette of claim 6 wherein the electrical traces are composed of a material configured to melt at a lower temperature than the rest of the stamped circuit.

8. The cassette of claim 6 wherein at least two of the terminals are separately stamped pieces electrically adhered to each other and the housing.

9. The cassette of claim 8 wherein the protrusions are heated to stake the fuse circuit to the housing.

10. The cassette of claim 1 wherein at least two of the terminal are connected to the same connector to provide parallel fusing.

11. The cassette of claim 10 wherein at least one of the blades includes a spring to form a female connector.

* * * * *